US007055276B2

(12) United States Patent
McPherson

(10) Patent No.: US 7,055,276 B2
(45) Date of Patent: Jun. 6, 2006

(54) HARMONIC DAMPER TO DAMPEN FIREARM VIBRATION

(76) Inventor: Mathew A. McPherson, Route 2, P.O. Box 58, Norwalk, WI (US) 54648

( * ) Notice: Subject to any disclaimer, the term of this patent is extended or adjusted under 35 U.S.C. 154(b) by 0 days.

(21) Appl. No.: 10/871,317

(22) Filed: Jun. 18, 2004

(65) Prior Publication Data

US 2006/0048638 A1 Mar. 9, 2006

(51) Int. Cl.
*F41A 21/00* (2006.01)

(52) U.S. Cl. ..... 42/1.06; 42/97; 89/14.3; 188/381

(58) Field of Classification Search ..... 42/1.06, 42/97; 89/14.3; 188/391, 174
See application file for complete search history.

(56) References Cited

U.S. PATENT DOCUMENTS

| | | | | |
|---|---|---|---|---|
| 3,381,405 | A * | 5/1968 | Edwards | 42/74 |
| 4,156,979 | A | 6/1979 | Katsenes | 42/1.06 |
| 5,505,118 | A | 4/1996 | Arnesen et al. | 89/14.3 |
| 5,513,730 | A * | 5/1996 | Petrovich et al. | 188/271 |
| 5,827,992 | A * | 10/1998 | Harris et al. | 89/191.01 |
| 6,257,220 | B1 | 7/2001 | McPherson et al. | 124/89 |
| 6,382,201 | B1 | 5/2002 | McPherson et al. | 124/89 |

* cited by examiner

*Primary Examiner*—J. Woodrow Eldred
(74) *Attorney, Agent, or Firm*—Vidas, Arrett & Steinkraus, PA

(57) ABSTRACT

A damper for reducing recoil and vibrations during and after firing a firearm may comprise a resilient member and a weight. The resilient member may mounted to a portion of a firearm having a surface suitable for engaging and retaining the resilient member therein, and the resilient member may have an inside surface suitable for engaging and retaining the weight.

25 Claims, 18 Drawing Sheets

HARMONIC DAMPER TO DAMPEN FIREARM VIBRATION

BACKGROUND OF THE INVENTION

This invention relates to a damper which may be used to reduce vibrations in a firearm.

Firearms for firing projectiles are well known. For example, rifles, pistols, machine guns and even tanks and howitzers may be considered firearms. A firearm may fire a projectile using a propellant, such as an explosive charge or a compressed gas.

Upon firing a projectile, a firearm will generally experience an initial recoil and various residual vibrations. Residual vibrations may be present throughout the firearm as a whole, and further, more individualized vibrations may be present within individual components, such as the stock and the barrel, as each part may vibrate and/or resonate at certain frequencies.

It would be desirable to damp the recoil and vibrations present in a firearm during and after the firing of a projectile.

U.S. Pat. Nos. 6,257,220 and 6,382,201 to McPherson et al. discuss vibration dampers as applied to archery bows, and are incorporated herein by reference in their entireties.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The present invention comprises a damper for reducing recoil and vibrations during and after firing a firearm.

In one embodiment, a damper may comprise a resilient member and a weight. The resilient member may be mounted to a portion of a firearm having a surface suitable for engaging and retaining the resilient member therein, and the resilient member may have an inside surface suitable for engaging and retaining the weight.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
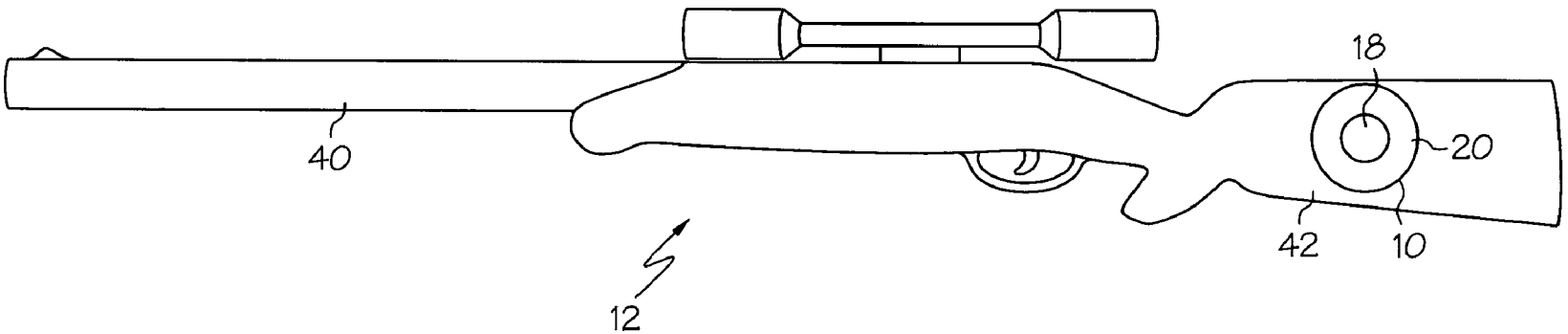
FIG. 1 depicts a rifle having a damper in the stock.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 depicts a firearm 12, such as a rifle, having a damper 10 which may absorb vibrations and reduce recoil of the weapon during and after the firing of a projectile. The damper 10 may be installed in a housing or mount 42, which may be a portion of the firearm 12. As shown in FIG. 1, the damper 10 is mounted to the rifle stock, and thus the rifle stock comprises the mount 42. In some embodiments, the mount 42 may comprise a grip, handle, barrel or a separate shroud or bracket that may be coupled to the firearm.

A damper 10 may comprise a weight 18 and a resilient portion or member 20. Desirably, the weight 18 provides a mass that is used by the damper 10 in conjunction with the resilient member 20 to resist movement and/or damp vibrations. The weight 18 may be supported by the resilient member 20 and may deflect with respect to the mount 42. Upon a deflection between the weight 18 and the mount 42, portions of the resilient member 20 may elongate while other portions may compress and/or distend. Inherent resilience of the resilient member 20 may then work to eventually return the weight 18 to the original position.

The weight 18 may be at least partially supported by the resilient portion 20. In some embodiments, the weight 18 may be entirely supported by the resilient portion 20, and may even be located within the resilient portion 20. The resilient portion 20 may be at least partially supported by the mount 42, and may be entirely supported by the mount 42.

The weight 18 may be formed from any suitable material and is desirably a fairly dense metal such as tungsten, lead, steel, brass, aluminum, and various alloys and combinations thereof. The weight 18 may additionally be formed from non-metals such as plastics, rubbers and the like. In some embodiments, the weight 18 may comprise the same material as the resilient portion 20.

The resilient portion 20 desirably has a greater elasticity than the weight 18. The resilient portion 20 may comprise an elastic or elastomeric material, and may be constructed in whole or in part from a variety of materials including Anylin®, Santoprene®, rubber, plastic, and the like.

As shown in FIG. 1, in some embodiments, the damper 10 may have an overall cylindrical shape. The weight 18 may be solid, and may have a cylindrical shape. The resilient portion 20 may be solid, and may have an annular shape. A resilient portion 20 having an annular shape may have a central axis, and may be oriented such that the central axis of the resilient portion is orthogonal to the longitudinal axis of the barrel 40 of the firearm 12.

A damper 10 may be particularly suited to damping shock or vibrations in a damping plane. For example, a resilient portion 20 having an annular shape may have a central axis, and the damping plane of the damper 10 may be orthogonal to the central axis. A damping plane may have a first axis and a second axis. Desirably, the damper 10 may be mounted such that a damping plane axis is parallel to the longitudinal axis of the barrel 40 of the firearm 12.

Figure 2:
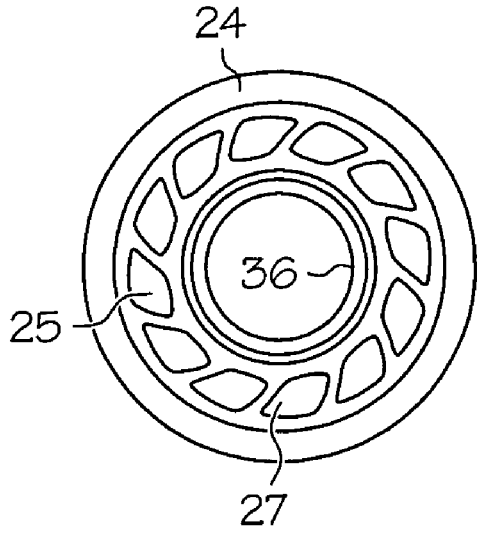
FIG. 2 shows an embodiment of a damper.
Figure 3:
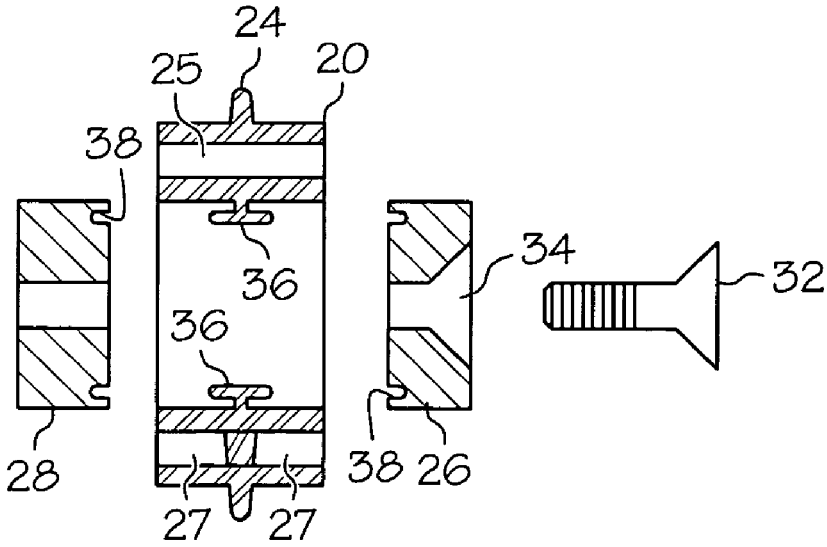
FIG. 3 shows another embodiment of a damper.

FIGS. 2 and 3 show an alternative embodiment of a damper 10. The resilient portion 20 may include one or more apertures 25. The location, size and shape of the apertures 25 in the resilient portion impact the performance characteristics of the damper 10. Apertures 25 may extend through the entire depth of the resilient portion 20. Alternatively, a resilient portion 20 may include cavities 27 which do not extend through the entire depth of the resilient portion 20.

The weight 18 may comprise a plurality of portions which may be secured to one another. FIG. 3 shows a first weight portion 26, a second weight portion 28 and a fastener 32. The resilient portion 20 may further include a mating portion 36 which may help to secure the weight 18 to the resilient portion 20. The first weight portion 26 and the second weight portion 28 may include retaining grooves 38 which may be shaped to receive a mating portion 36. The fastener 32 may extend through the first weight portion 26 and may be attached to the second weight portion 28, thereby securing the weight 18 to the resilient portion 20.

The resilient portion 20 may further include a collar 24 which may provide additional securement to the mount 42. A collar 24 may be formed integrally with the resilient portion 20 or may comprise a separate piece. A collar 24 may be formed from a different material than the resilient portion 20.

Figure 4:
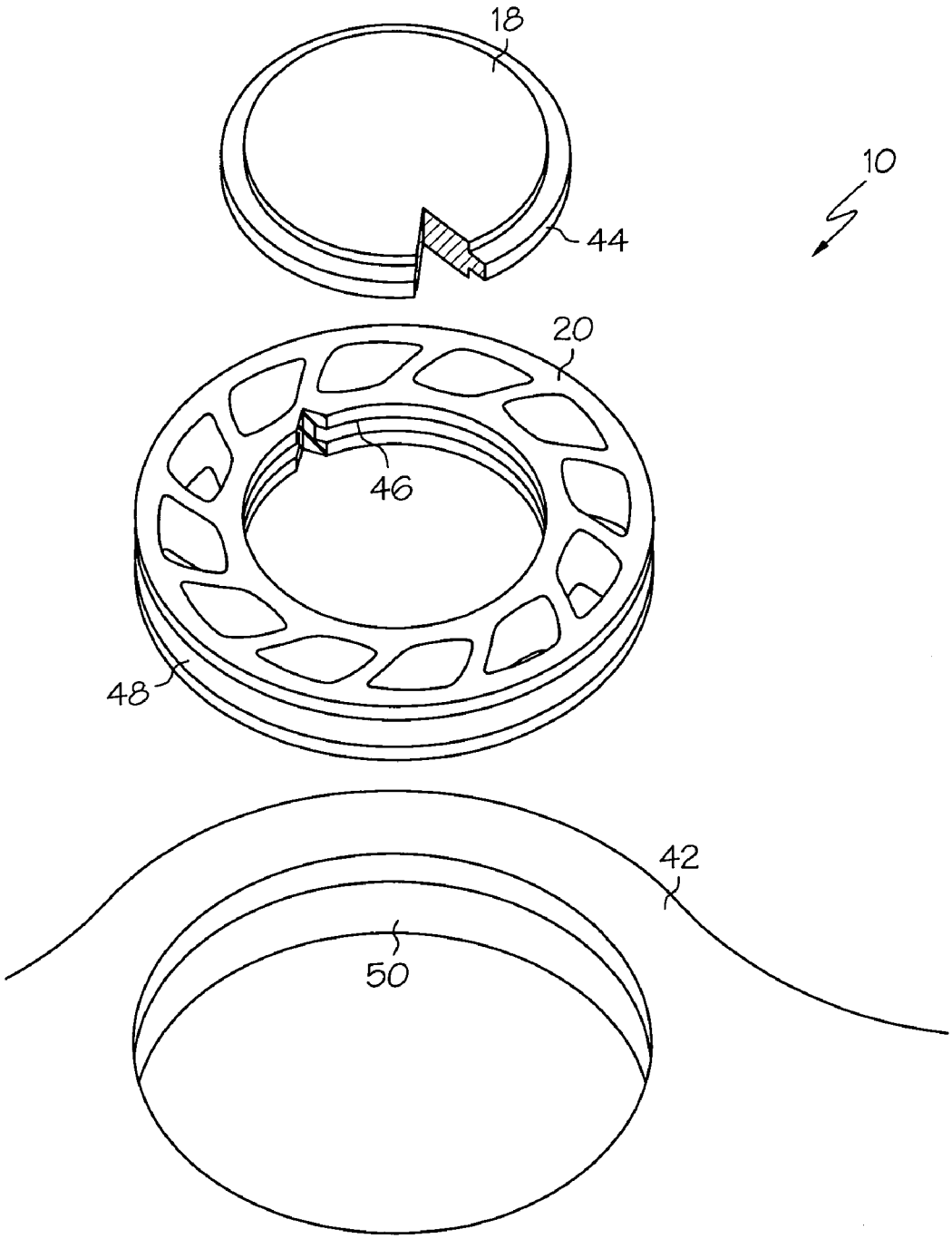
FIG. 4 shows another embodiment of a damper.

FIG. 4 shows another embodiment of a damper 10 according to the present invention. The weight 18 may include a mating portion 44, such as a ridge, and the resilient portion 20 may include a mating portion 46, such as a groove, arranged to receive the mating portion 44 of the weight. The resilient portion 20 may further include another mating portion 48, for example a groove, for securement to the mount 42. Accordingly, the mount 42 may include a mating portion 50, such as a ridge, arranged to receive the mating portion 48 of the resilient member 20.

Figure 5:
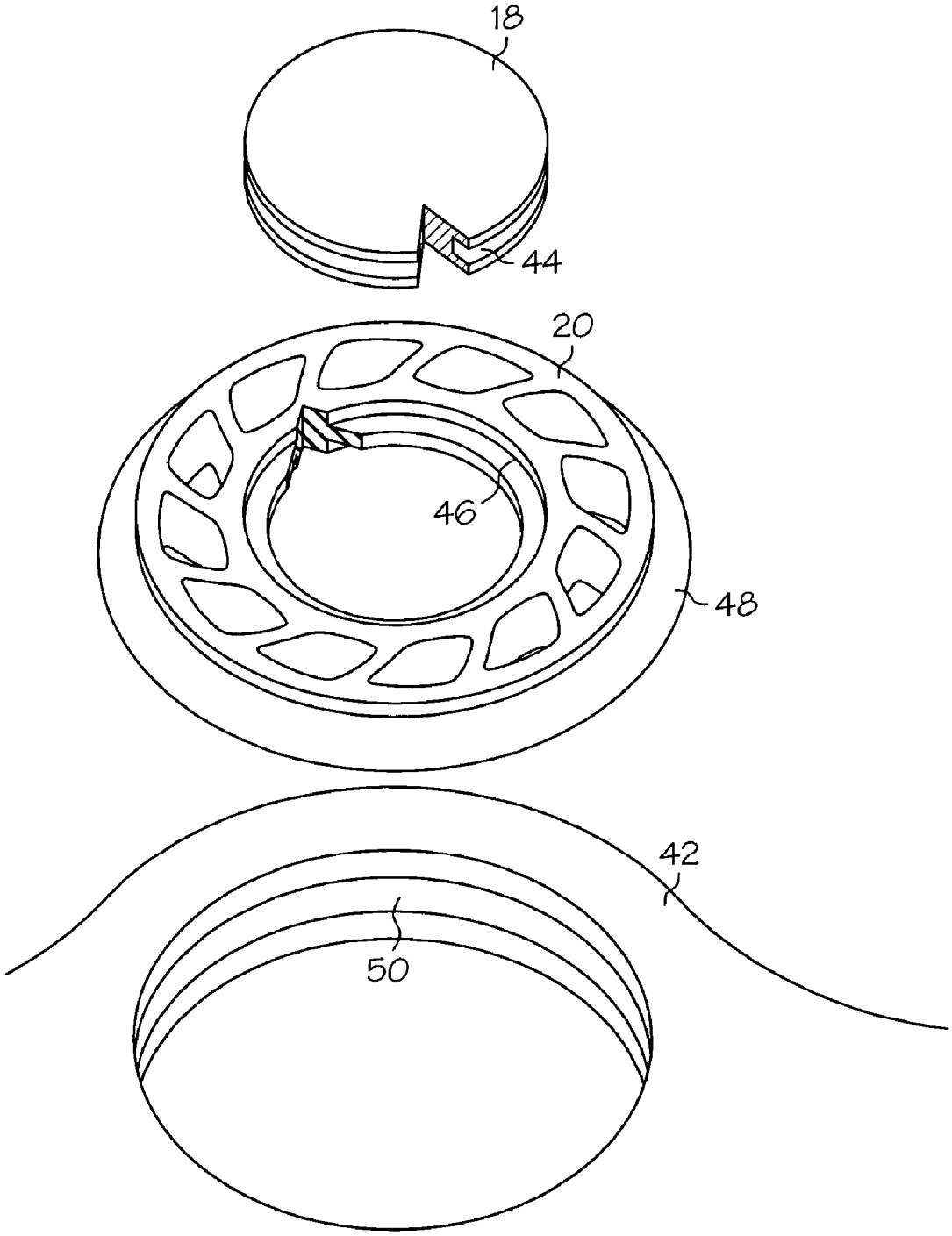
FIG. 5 shows another embodiment of a damper.

FIG. 5 shows another embodiment of a damper 10 according to the present invention. The weight 18 may include a mating portion 44, such as a groove, and the resilient portion 20 may include a mating portion 46, such as a ridge, arranged to receive the mating portion 44 of the weight. The resilient portion 20 may further include another mating portion 48, for example a ridge, for securement to the mount 42, which may include a mating portion 50, such as a groove, arranged to receive the mating portion 48 of the resilient member 20.

It should be noted that the various mating portion embodiments depicted in the Figures are merely examples of configurations which may be used to join the mount 42, resilient portion 20 and weight 18. The configurations shown and described herein are preferred, as they allow a user to remove and replace the various components as desired. Alternative arrangements may include the application of permanent or temporary adhesives as well as other interfacing arrangements. The present invention is directed at these configurations and all other which may be known to one of ordinary skill in the art.

Figure 6:
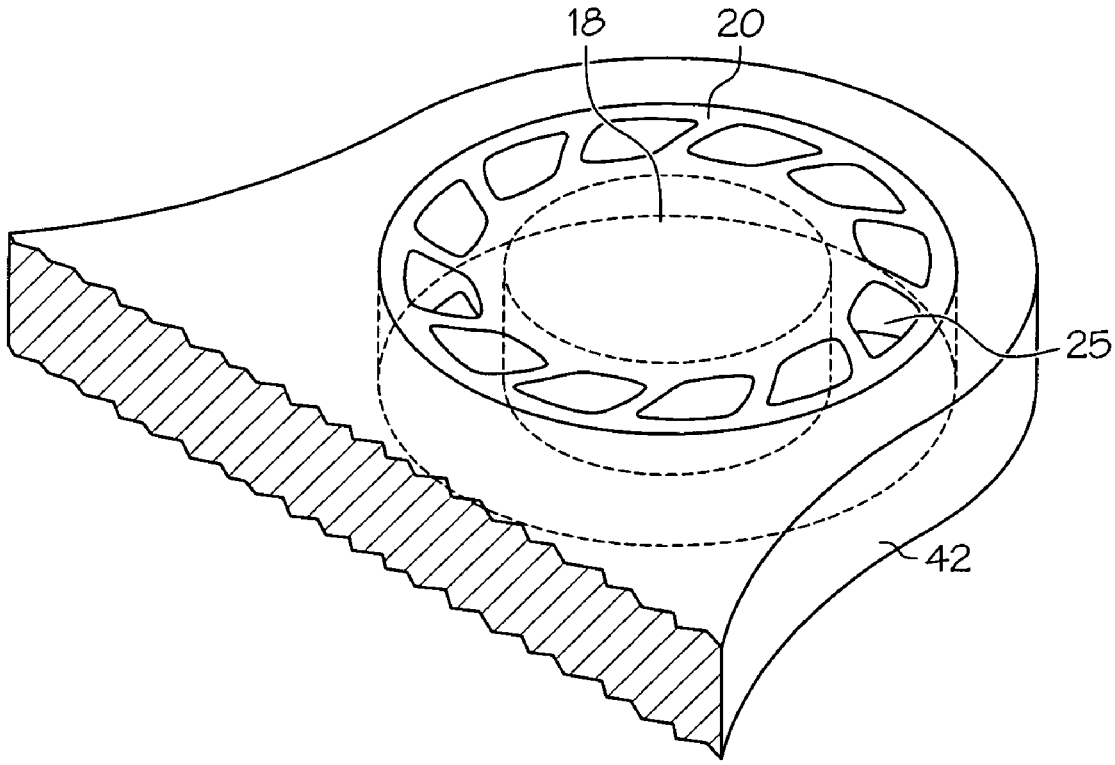
FIG. 6 shows another embodiment of a damper.

FIG. 6 shows another embodiment of a damper 10 according to the present invention. The weight 18 and resilient portion 20 may comprise a single piece of material. Thus, the weight 18 may be integrally formed with the resilient portion 20. The resilient portion 20 may be entirely supported by a mount 42. The resilient portion may include one or more apertures 25 (or cavities 27 as described with respect to FIGS. 2 and 3).

Figure 7:
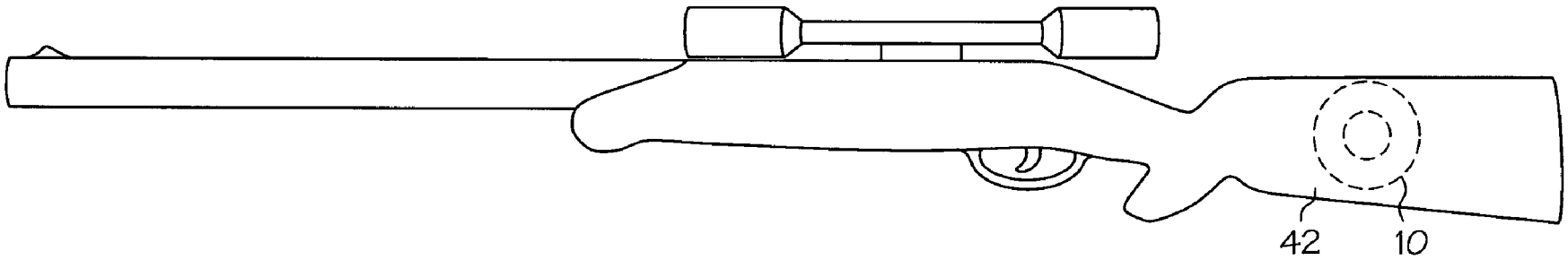
FIG. 7 shows a rifle having a concealed damper.

FIG. 7 shows an embodiment of an inventive damper 10 concealed within the stock 42 of a rifle. A damper 10 will damp vibrations and recoil regardless of whether or not the damper 10 is visible.

Figure 8:
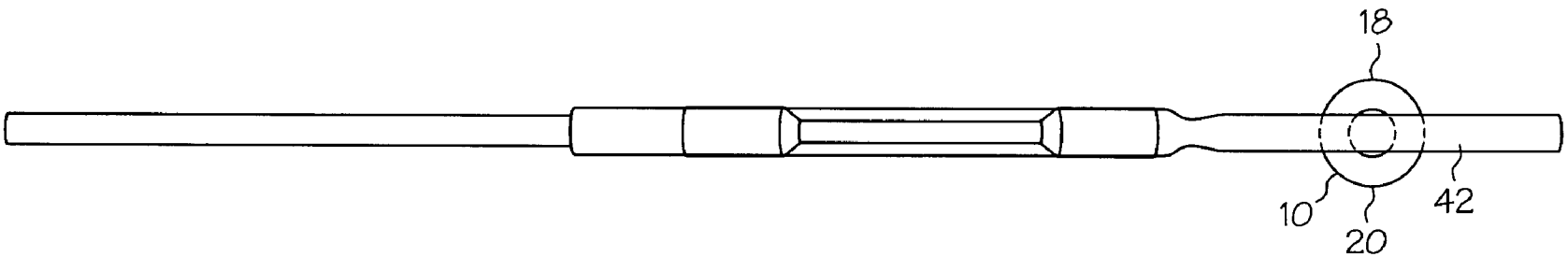
FIG. 8 shows a rifle having a damper in another orientation.

FIG. 8 shows another embodiment of an inventive damper 10 placed in the stock 42 of a rifle. The damper 10 of FIG. 8 is rotated 90° with respect to the damper 10 depicted in FIG. 7. A damper 10 may be placed in any orientation with respect to the mount 42 that is sufficient to allow damping of vibrations.

Figure 9:
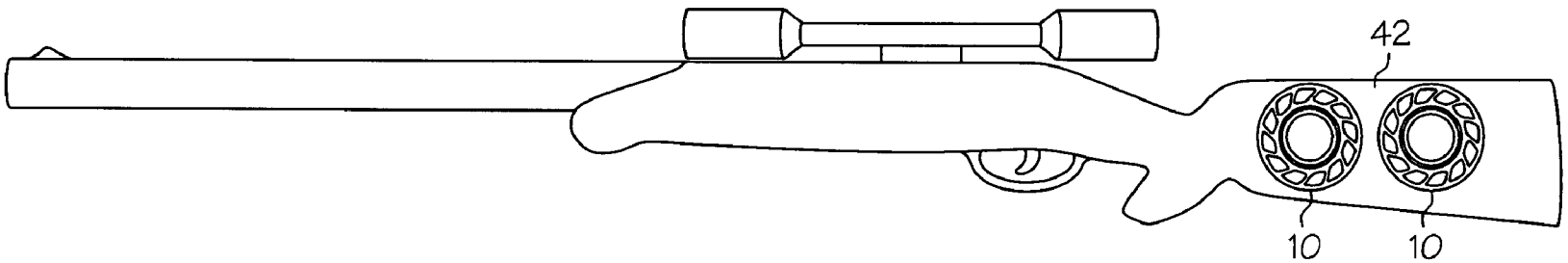
FIG. 9 shows a rifle having multiple dampers.

FIG. 9 shows a rifle having multiple dampers 10. Dampers 10 may be placed in any location desired to reduce undesired vibrations. As shown, two dampers 10 are disposed in the rifle stock 42. Multiple dampers 10 may be placed in a common mount 42, or may be placed in separate mounts. For example, a first damper may be mounted to a rifle stock while a second damper may be mounted to a rifle barrel. Dampers 10 may be used in plural to achieve a desired overall damping effect in any given firearm.

Figure 10:
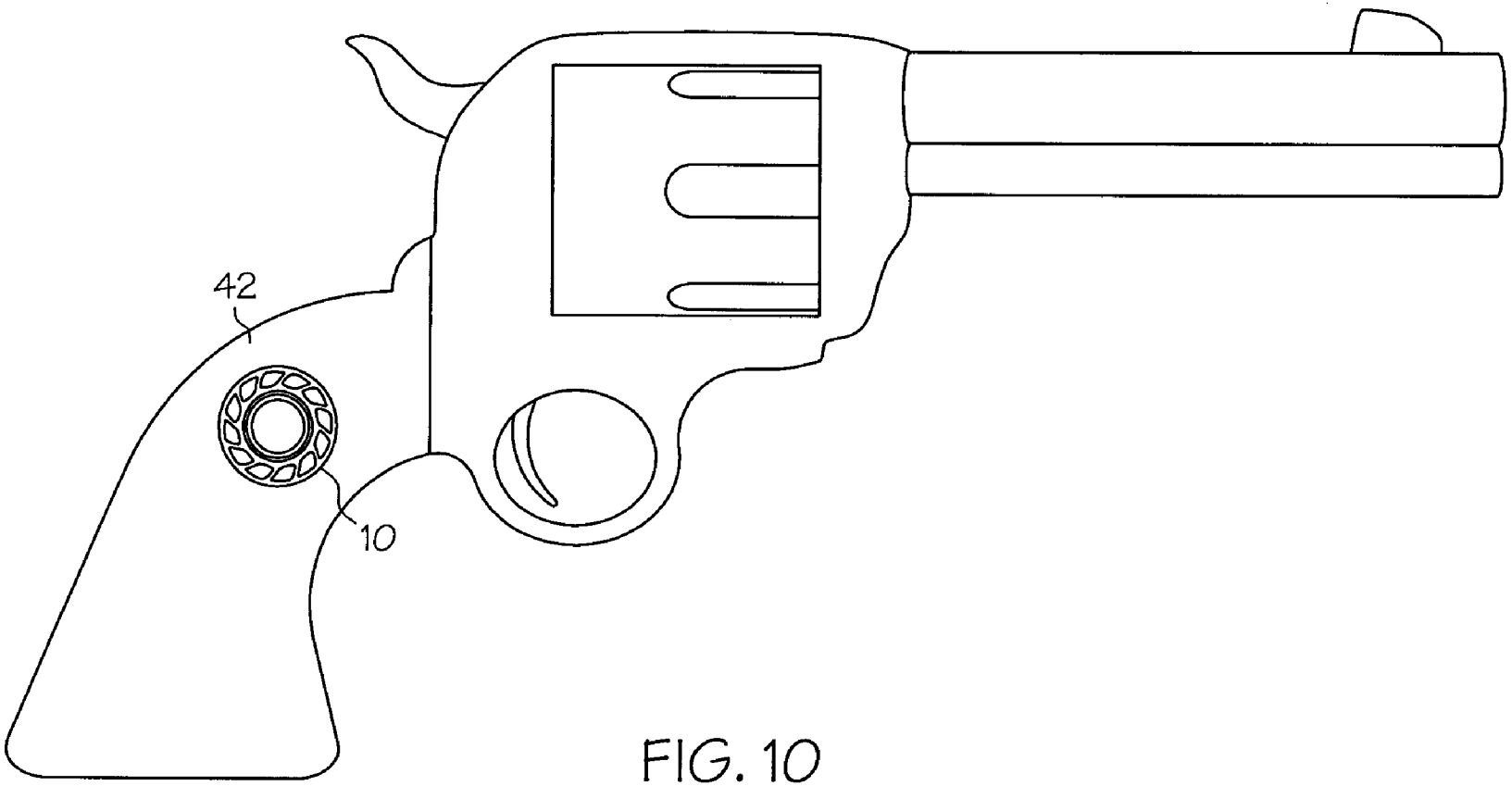
FIG. 10 shows a pistol having a damper in the handle.

FIG. 10 shows a damper 10 located in the handle of a pistol. Thus, the handle may comprise a mount 42.

Figure 11:
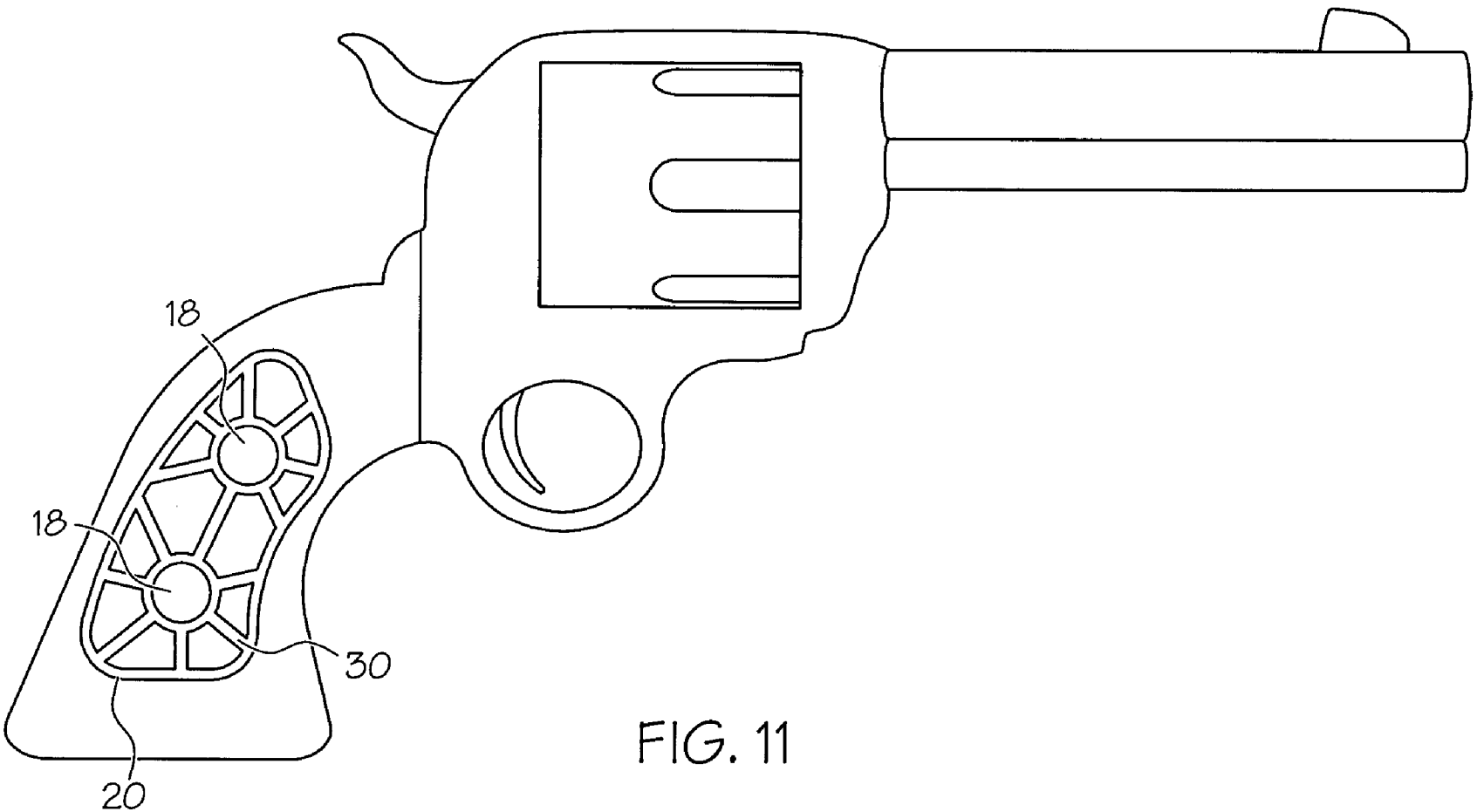
FIG. 11 shows a pistol and a further embodiment of a damper.

FIG. 11 shows another embodiment of a damper 10 located in the handle of a pistol. The damper 10 may comprise a resilient portion 20 and a plurality of weights 18. The weights 18 may be any appropriate size and shape, and need not be identical to one another. Desirably, each weight is entirely supported by the resilient portion 20. The resilient portion 20 may include apertures 25 or cavities as herein defined, which may be sized and placed to achieve the overall damping characteristics desired. A number of columns 30 may be defined in the resilient portion 20 between apertures 25. The length, width and thickness of the columns 30 may be varied to achieve desired damping characteristics.

Figure 12:
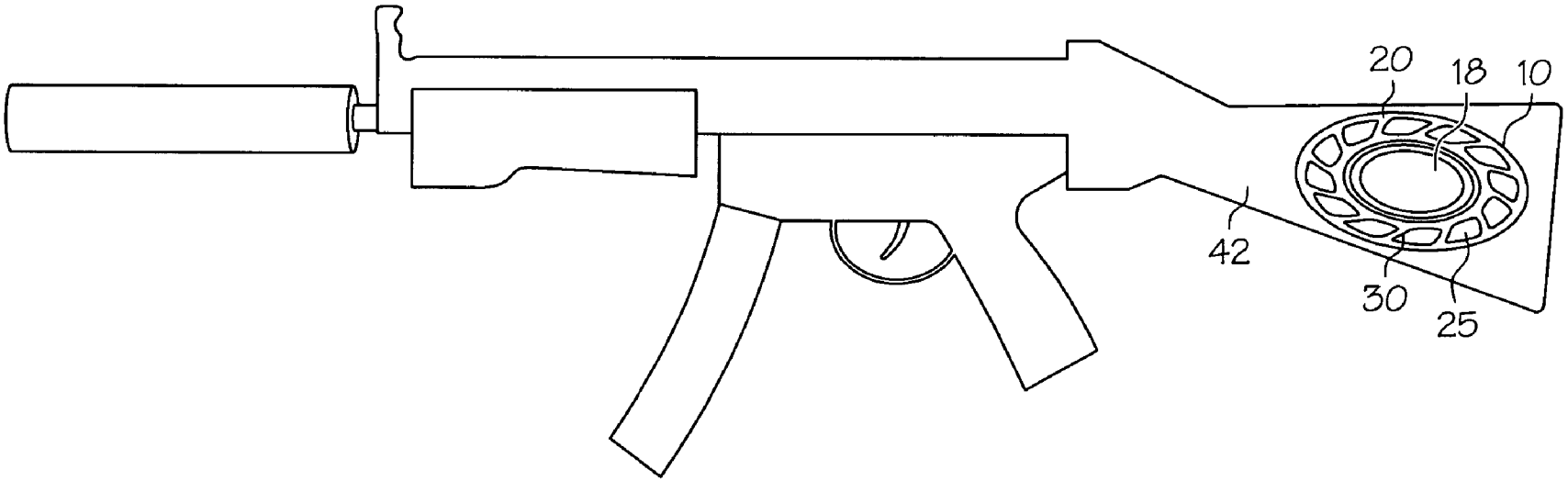
FIG. 12 shows an automatic firearm and an embodiment of a damper.
Figure 13:
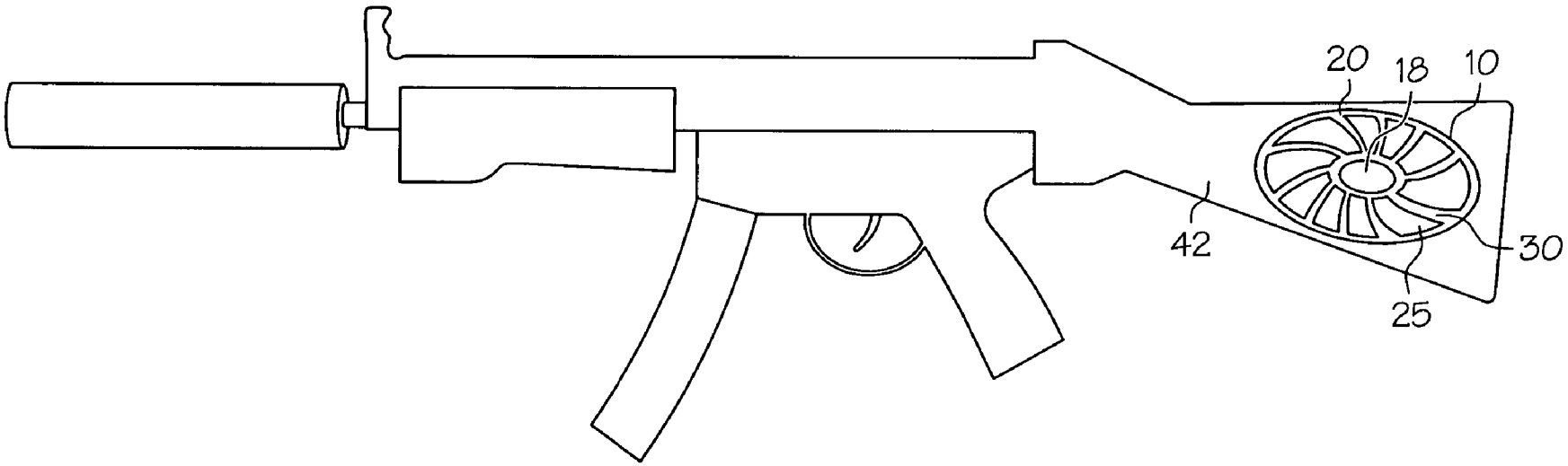
FIG. 13 shows an automatic firearm having another embodiment of a damper.

FIGS. 12 and 13 show further embodiments of a damper 10 located in the stock 42 of an automatic rifle. The shape of a damper 10 may be selected to allow optimum performance and placement in a given available space. The shape of a resilient portion 20 may be selected to match the boundaries of a given mount 42. The resilient portions 20 of the dampers 10 shown in FIGS. 12 and 13 have an ovular outer shape.

A weight 18 may have any desirable shape. The weight 18 shown in FIG. 12 has an ovular shape, which is similar to the outer shape of the resilient portion 20. The weight 18 of FIG. 13 has a circular shape. The apertures 25 and columns 30 included in a resilient portion 20 may be adjusted according to the shape of the weight 18 and the damping effects desired.

Figure 14:
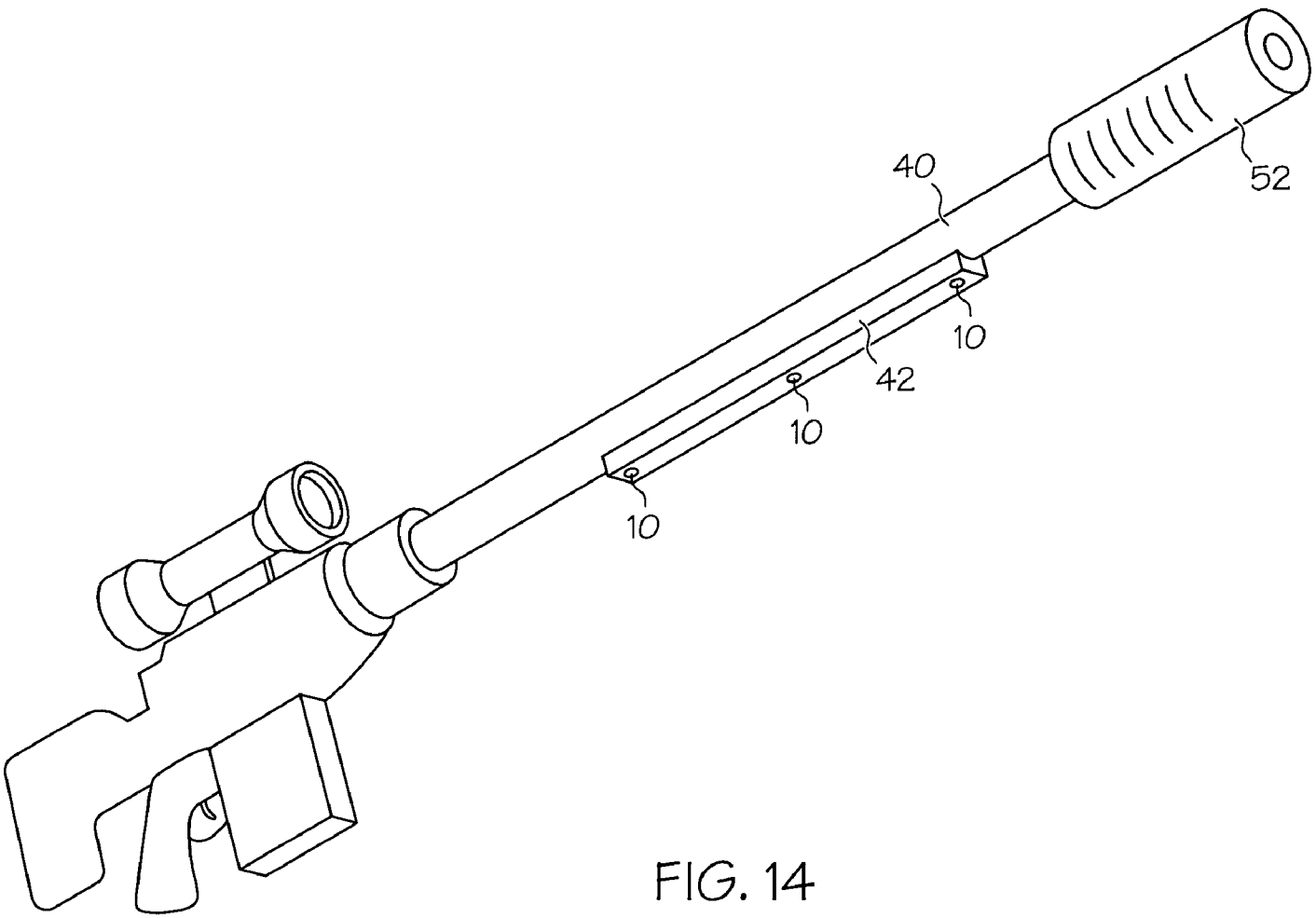
FIG. 14 shows a rifle with dampers installed in a mount along the barrel.

FIG. 14 shows a rifle having a plurality of dampers 10 in a mount 42 that is attached to the gun barrel 40. High powered firearms which employ a muzzle brake 52 are prone to barrel vibrations because the brake 52 may cause one end of the barrel 40 to displace longitudinally with respect to the other end of the barrel upon firing. Dampers 10 arranged along the barrel attenuate vibrations in the barrel 40.

In some embodiments, the invention may comprise dampers 10 placed along a gun barrel 40, wherein the dampers 10 may be placed between vibration nodes. Vibrations may occur in different forms, and dampers 10 may be placed to attenuate various vibrations, such as vibrations which result from axial extension, torsion and bending displacements.

Figure 15:
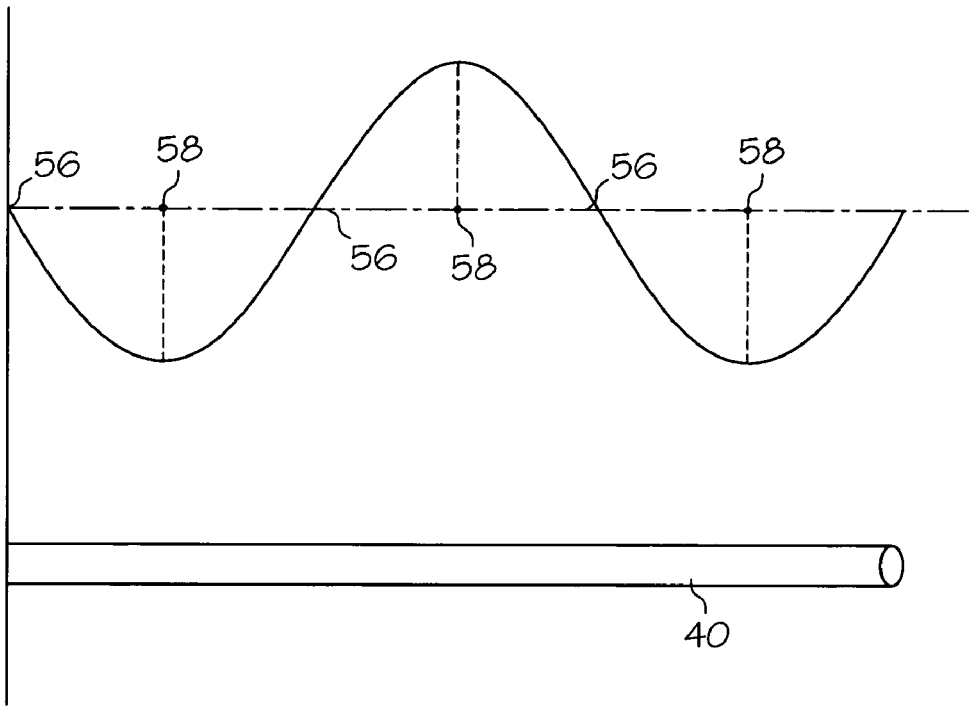
FIG. 15 shows a vibration model for a gun barrel.

FIG. 15 shows a vibration model along the length of a gun barrel 40, a vibration represented by a sine wave 54. Zero-crossings 56 of the sine wave 54 represent vibration nodes 56 of the barrel 40. Portions of the sine wave 54 that reach maximum or minimum represent a midpoint 58 between nodes 56. Vibrations and displacement of the barrel 40 are generally the greatest at a midpoint 58 between nodes 56. Thus, dampers 10 placed at or near the midpoints 58 may have the greatest damping effect.

Figure 16:
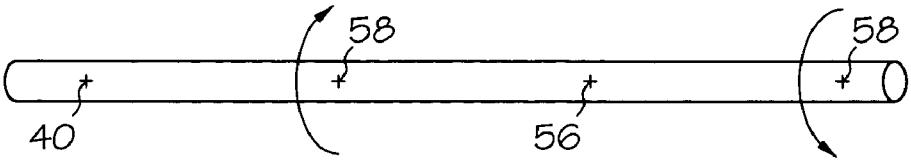
FIG. 16 shows an example of torsional vibration in a gun barrel.

FIG. 16 illustrates a torsional vibration of a gun barrel 40 having one node 56. Optimum placement points for dampers are at or near midpoints 58 between nodes 56.

Figure 17:
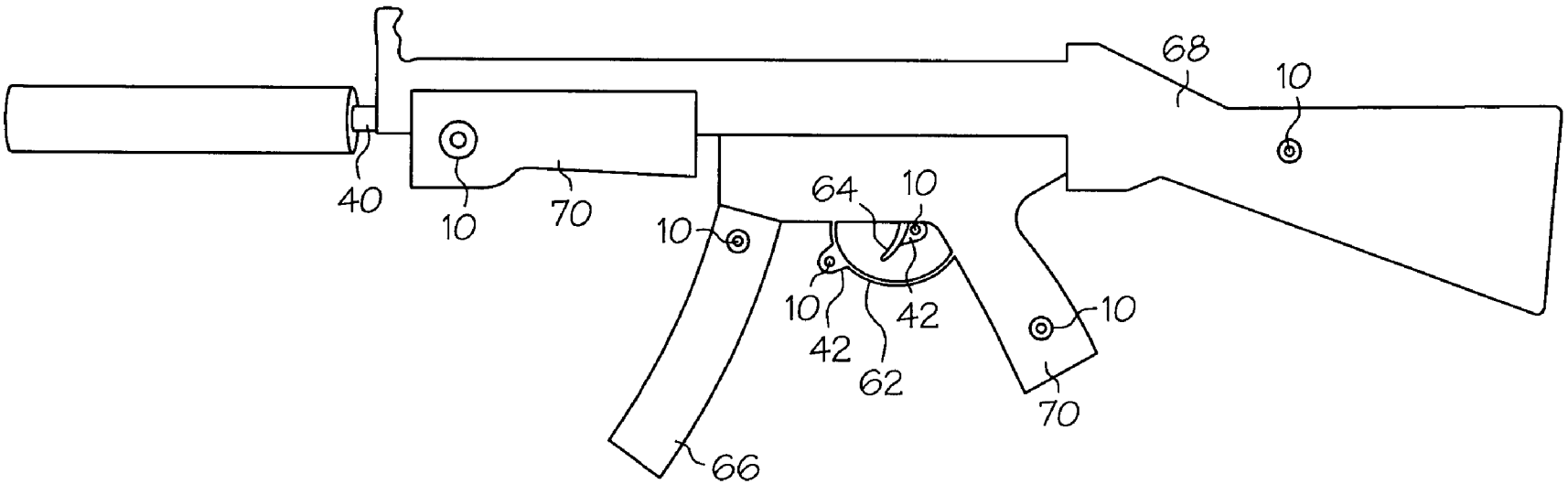
FIG. 17 shows a firearm and a plurality of possible locations for a damper.

FIG. 17 shows a firearm 12. Dampers 10 may be mounted to or within any suitable portion of the firearm 12. For example, dampers 10 may be attached to a trigger guard 62, a trigger 64, a magazine 66, a barrel 40, a stock 68 and any grip or handle 70. Dampers 10 may also be attached to portions of a bolt, bolt carrier and other parts of a bolt assembly, a firing pin, a cocking piece, a receiver, a slide, a hammer, and the like. Dampers 10 may also be attached to external attachments to a firearm 12, such as a silencer, scope, stand or other accessory.

Figure 18:
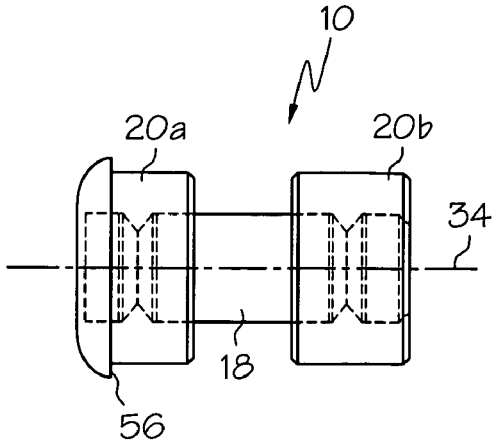
FIG. 18 shows another embodiment of a damper.
Figure 19:
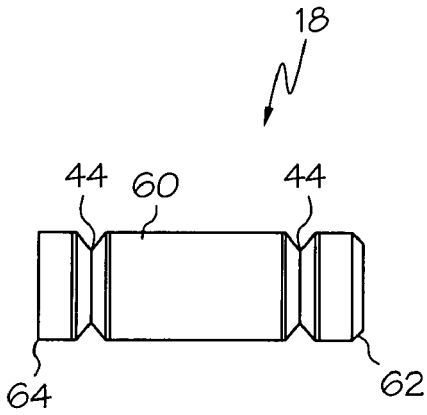
FIG. 19 shows an embodiment of a weight.

FIG. 18 shows another embodiment of a damper 10, which may comprise a weight 18, a first resilient portion 20*a* and a second resilient portion 20*b*. The damper 10 may have a longitudinal axis 34. FIGS. 19–21C show the components of the damper 10 in more detail. Referring to FIG. 19, a weight 18 may be cylindrical in shape having a central longitudinal axis. The weight 18 may include an outer surface 60 and may include one or more mating portions 44 extending beneath the outer surface 60. Each mating portion 44 may comprise a recess or groove, and may extend circumferentially about at least a portion of the weight 18. An edge of the weight 18 may comprise a rounded edge 62 or a squared edge 64.

Figure 20A:
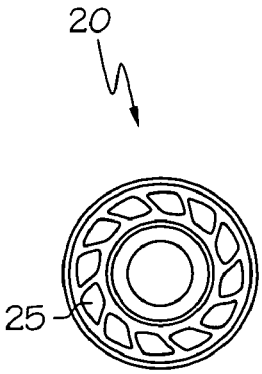
FIGS. 20A and 20B show respective front and side views of an embodiment of a resilient member.
Figure 20B:
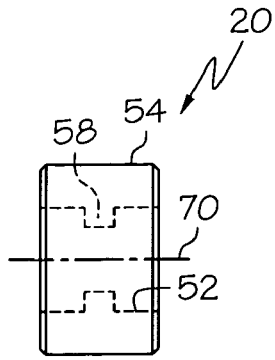

FIGS. 20A and 20B show front and side views of an embodiment of a resilient member 20, which may comprise a second resilient member 20*b* in some embodiments of a damper 10. The resilient member 20 may comprise an annular shape having an inner surface 52, an outer surface 54 and a central axis 70. The resilient member 20 may further include a plurality of apertures 25. Each aperture 25 may have a longitudinal axis which may be parallel to the central axis 70. The inner edge 52 may include an internal flange or mating portion 58 which may extend toward the central longitudinal axis. When the resilient member 20 is positioned to support the weight 18, a portion of the outer surface 60 of the weight 18 may abut the inner surface 52 of the resilient member 20. The outer surface 60 of the weight 18 may be frictionally engaged with the inner surface 52 of the resilient member 20. Further, the mating portion 58 of the resilient member 20 may be engaged with the mating portion 44 of the weight 18. For example, the internal mounting flange 58 of the resilient portion 20 may extend into the groove 44 of the weight 18.

Figure 21A:
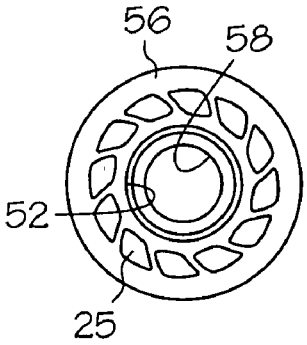
FIGS. 21A–21C show respective front, side and back views of another embodiment of a resilient member.
Figure 21B:
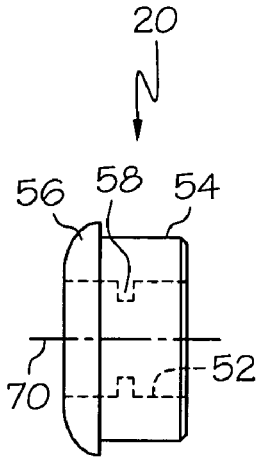
Figure 21C:
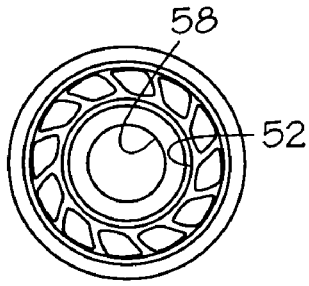

FIGS. 21A–21C show front, back and side views of another embodiment of a resilient portion 20, which may comprise a first resilient member 20*a* in some embodiments of a damper 10. The resilient member 20 may include the features of other resilient portions described herein, and may also include a mounting flange 56 which may extend a greater radial distance from the central longitudinal axis than the outer edge 54. The mounting flange 56 may abut a portion of a mount to which the resilient portion is engaged. For example, when the damper 10 is installed within a gun stock or other mount, the resilient member 20 may be positioned such that the outer surface 54 of the resilient member 20 abuts an inner surface of the stock or mount. The mounting flange 56 may be positioned to abut an outer surface of the stock or mount. The mounting flange 56 may prevent the resilient portion 20, and thus the damper 10, from translocating farther into stock or mount.

Figure 22A:
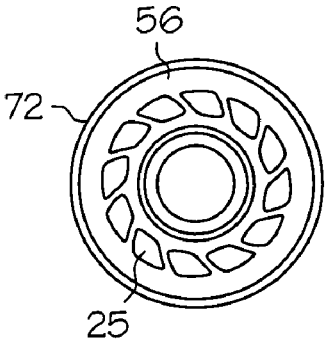
FIGS. 22A–22C show respective front, side and back views of another embodiment of a resilient member.
Figure 22B:
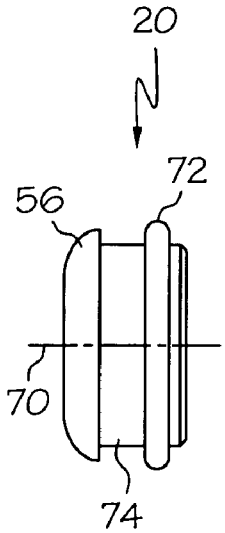
Figure 22C:
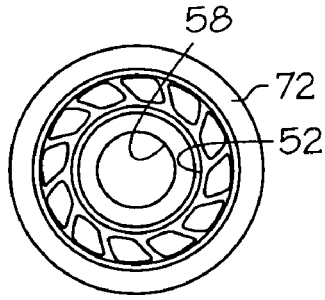

FIGS. 22A–22C show front, back and side views of another embodiment of a resilient portion 20. The resilient member 20 may include the features of other resilient portions described herein, and may also include a frictional engagement flange 72 which may extend from the outer edge 54. In some embodiments, the frictional engagement flange 72 may extend a greater radial distance from the central longitudinal axis than the mounting flange 56. When the resilient member 20 is engaged with a mount, the frictional engagement flange 72 may deform and frictionally engage the mount.

In some embodiments, the space between the frictional engagement flange 72 and the mounting flange 56 may comprise a mating portion or channel 74. The channel 74 may receive an appropriate mating portion of a mount.

In other embodiments, a damper 10 may comprise a weight 18 and any number of resilient members 20. Any suitable embodiment(s) of resilient members 20 may be used in a damper 10. The weight 18 may include a mating portion 44 for each resilient member 20. The resilient members 20 may be spaced along the length of the weight 18. For example, three, four or five or more resilient members 20 may be used with a single weight 18.

Figure 23:
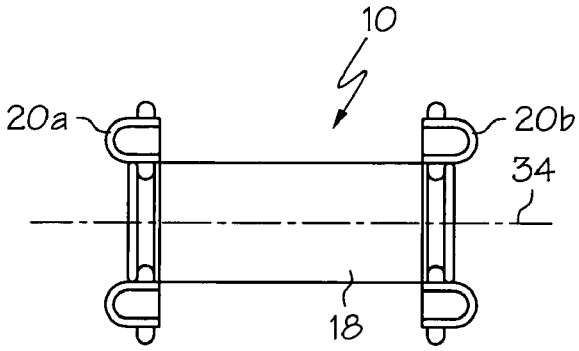
FIG. 23 shows another embodiment of a damper.

FIG. 23 shows another embodiment of a damper 10, which may comprise a weight 18, a first resilient portion 20*a* and a second resilient portion 20*b*. The first resilient portion 20*a* and the second resilient portion 20*b* may be similarly shaped and may be oriented in opposite directions.

In some embodiments, an excursion damper may comprise a single resilient member 20 and a weight 18. The damper 10 may have a longitudinal axis 34. The weight 18 may displace with respect to the resilient member(s) 20 in directions orthogonal to the longitudinal axis 34. The damper 10 may further comprise an excursion damper 10, wherein the weight may displace with respect to the resilient members 20 in directions parallel to the longitudinal axis 34. Dampers 10 may be mounted to a firearm according to any orientation. For example, an excursion damper may be mounted such that the longitudinal axis 34 of the weight 18 is parallel to the longitudinal axis of the gun barrel.

Figure 24:
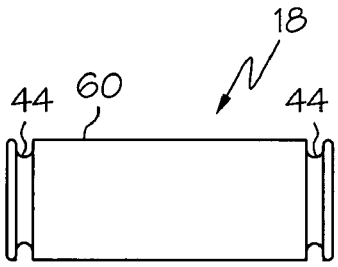
FIG. 24 shows another embodiment of a weight.

FIG. 24 shows an embodiment of a weight 18 in more detail. The weight 18 may be cylindrical in shape and may have a central longitudinal axis. The weight 18 may include an outer surface 60 and may include one or more mating portions 44 extending beneath the outer surface 60. Each mating portion 44 may comprise a recess or groove, and may extend circumferentially about at least a portion of the weight 18.

Figure 25A:
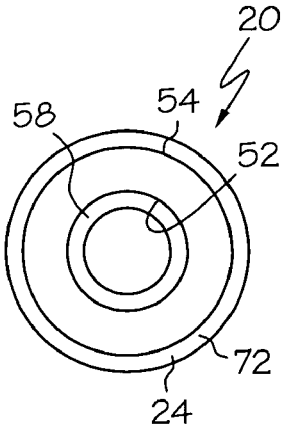
FIGS. 25A–25C show respective front, side sectional and rear views of an embodiment of a resilient member.
Figure 25B:
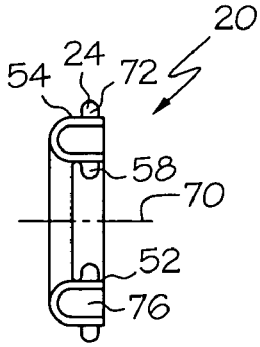
Figure 25C:
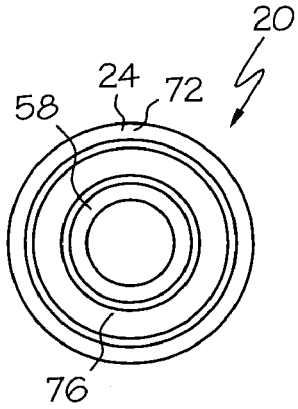

FIGS. 25A–25C show front, sectional and back views of an embodiment of a resilient portion or member 20. The resilient member 20 may comprise an annular shape having an inner surface 52, an outer surface 54 and a central axis 70. The resilient member 20 may include an annular channel 76, which may extend about the longitudinal axis 70 and may have a U-shaped cross-section. The vertical axis of the U-shape may be oriented in a direction parallel to the longitudinal axis 34 of the damper 10. The annular channel 76 may provide added compliance in directions parallel to the central axis 70. Thus, a weight 18 that is engaged with the resilient member 20 may move in directions parallel to the central axis 70.

Dampers 10 according to the present invention may have any suitable size or shape, and may be made from any suitable materials. Further, different weights 18 may be used within a given damper 10. For example, a plurality of interchangeable weights 18, each made from a material of varying density, may be used within a given resilient portion 20. The weight 18 to be used may be selected to alter performance characteristics which an individual user may find more or less desirable.

Resilient portions 20 may be similarly interchangeable. For example, a plurality of resilient portions 20 may be sized to fit in a given mount 42 and used with a given weight 18. The different resilient portions 20 may be made from different materials and/or have differing configurations of apertures 25, cavities 27 and columns 30. An appropriate resilient portion 20 may be selected to achieve preferred damping and attenuation characteristics.

The overall shape of a damper 10, and the individual elements of the damper 10, may be modified according to the application. With respect to firearms, the shape of a damper 10 may be selected to allow a damper to fit in a desired location. A circular damper may be equally responsive in all directions of a two-dimension plane and may be more desirable in certain applications than ovular, square, triangular or other custom shapes. Firearms often include internal space or hollow cavities that are not used for the firearm action assembly. In some embodiments, dampers 10 may be shaped to fit in available internal cavities present in existing firearms.

Dampers 10 as applied to firearms may be particularly useful with automatic firearms, which generally cycle at known rates. When an automatic firearm cycles rounds, major vibrations are generated at known intervals. Desirably, dampers 10 may be selected to optimally damp vibrations at frequencies which are generated by the cyclical firing. Thus, dampers 10 may act to reduce recoil and vibration in automatic weapons, making use of the weapons more comfortable and improving accuracy.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm vibration damper comprising:

a first resilient member, a second resilient member and a weight;

wherein the first resilient member comprises an elastomeric material and is mounted to a portion of a firearm, the first resilient member having an inside surface suitable for engaging and retaining the weight, the second resilient member is mounted to a portion of the firearm, the second resilient member contacting the weight; and wherein the first resilient member further comprises a central axis, the central axis being nonparallel to a longitudinal axis of a barrel of the firearm.

2. The firearm vibration damper of claim 1, wherein at least a portion of the second resilient member is made of an elastomeric material.

3. The firearm vibration damper of claim 1, wherein at least a portion of the weight is made of tungsten.

4. The firearm vibration damper of claim 1, wherein the weight is entirely supported by the first resilient member and the second resilient member.

5. The firearm vibration damper of claim 1, wherein an outer periphery of the first resilient member comprises the same shape as an outer periphery of the weight.

6. The firearm vibration damper of claim 1, wherein the first resilient member is mounted to a gun stock.

7. The firearm vibration damper of claim 1, wherein the first resilient member is mounted to a pistol grip.

8. The firearm vibration damper of claim 1, further comprising a second weight.

9. The firearm vibration damper of claim 8, wherein the second weight contacts the first resilient member and the second resilient member.

10. The firearm vibration damper of claim 1, wherein an outer periphery of the first resilient member comprises the same shape as an inner periphery of a cavity in the firearm that is not used for the firearm action assembly.

11. The firearms vibration damper of claim 1, wherein the damper is concealed within the firearm.

12. The firearm vibration damper of claim 1, wherein the first resilient member includes a plurality of apertures.

13. The firearm vibration damper of claim 12, wherein the first resilient member includes a plurality of columns.

14. The firearm vibration damper of claim 1, wherein the damper includes a damping plane, and the damper is oriented such that a longitudinal axis of a barrel of the firearm is parallel to an axis of the damping plane.

15. The firearm vibration damper of claim 1, wherein the central axis of the first resilient member is orthogonal to a longitudinal axis of a barrel of the firearm.

16. A firearm vibration damper comprising:

a resilient member and a weight;

wherein the resilient member is mounted to the firearm and comprises an inside surface suitable for engaging and retaining the weight;

the resilient member comprising an annular channel having a U-shaped cross-section, the U-shape having a main axis, the main axis of the U-shape oriented in a non-radial direction of the resilient member.

17. A firearm vibration damper comprising:

a resilient member, a first weight and a second weight;

the resilient member being attached to a firearm, the resilient member having a first inside surface suitable for engaging and retaining the first weight and a second inside surface suitable for engaging and retaining the second weight, the first weight being spaced apart from the second weight.

18. The firearm vibration damper of claim 17, wherein the resilient member comprises an elastomeric material.

19. A firearm vibration damper comprising:

a resilient member, a first weight and a second weight;

the resilient member being attached to a firearm, the resilient member having a first inside surface suitable for engaging and retaining first weight and a second inside surface suitable for engaging and retaining the second weight;

wherein the first weight and the second weight each have a central axis, the central axis of the first weight being parallel to and offset from the central axis of the second weight.

20. A firearm vibration damper comprising:

a mount, an elastomeric resilient member, and a weighted portion;

the mount being attached to a firearm, the mount having a surface suitable for engaging and retaining the resilient member therein, the resilient member having an inside surface suitable for engaging and retaining the weighted portion therein;

wherein the mount is attached to the firearm barrel; and wherein the damper is placed at a midpoint between vibration nodes of the barrel.

21. The vibration damper of claim 19, wherein the central axis of the first weight is oriented orthogonally to a longitudinal axis of a barrel of the firearm.

22. The firearm vibration damper of claim 16, wherein at least a portion of the resilient member comprises an elastomeric material.

23. The firearm vibration damper of claim 16, wherein the resilient member is arranged to bias the weight to a nominal position and to temporarily allow the weight to displace in three orthogonal directions with respect to the portion of the firearm engaging the resilient member.

24. The firearm vibration damper of claim 16, wherein the resilient member comprises a central axis that is non-parallel to a longitudinal axis of a barrel of the firearm.

25. The firearm vibration damper of claim 16, wherein the main axis of the U-shape is parallel to a central axis of the resilient member.

* * * * *